US005118308A

United States Patent [19]

Liu et al.

[11] Patent Number: 5,118,308

[45] Date of Patent: Jun. 2, 1992

[54] BUS CONNECTOR

[75] Inventors: Yun-Yu Liu, Taipei; Jih-Bin Lin, Chung Ho, both of Taiwan

[73] Assignee: Pan-International Industrial Cop., Taipei, Taiwan

[21] Appl. No.: 741,337

[22] Filed: Aug. 7, 1991

[51] Int. Cl.[5] ..... H01R 13/66

[52] U.S. Cl. ..... 439/620; 338/220; 338/232

[58] Field of Search ..... 361/355, 419; 338/220, 338/221, 232, 235, 252; 439/620

*Primary Examiner*—Gary F. Paumen

*Attorney, Agent, or Firm*—Fleit, Jacobson, Cohn, Price, Holman & Stern

[57] ABSTRACT

A bus connector comprising a base, an upper shell and a terminal unit, wherein said upper shell has resistor chambers for holding resistors from a bus and an elongated board at the front bottom edge thereof which is tightly pressed on the bus main track to which the connector is connected to seal off dust, and wherein said terminal unit has four terminals made in the same shape and respectively retained in four parallel grooves on the bottom edge of the base.

1 Claim, 3 Drawing Sheets

BUS CONNECTOR

BACKGROUND OF THE INVENTION

The present invention relates to a bus connector and relates more particularly to a bus connector comprised of an upper shell, a base and a terminal unit, which has resistor chambers for holding resistors from the bus and a dust protective board to seal off dust from a bus main track and, in which the terminals of the terminal unit can be made in the same shape to facilitate the manufacturing process.

In an automation system, all the circuits from several apparatus which execute an operation are gathered to a bus main track to which a subsidiary track from a controlling unit is connected by a bus connector, and therefore, said controlling unit can simultaneously control said several apparatus to operate. However, the known structures of bus connectors are not satisfactory in use because they are commonly complicated in structure. In the known structures of bus connectors, each terminal is made in a different shape which makes installation difficult and simultaneously increase the manufacturing cost. Further, the conventional bus connectors do not have any means to seal off dust from the bus main track to which they are connected, nor any means for holding the resistors from the bus fastened therein.

SUMMARY OF THE INVENTION

The present invention has been accomplished to eliminate the aforesaid disadvantages. It is therefore an object of the present invention to provide a bus connector for connecting a bus to a bus main track, which is simple in structure, inexpensive to manufacture and easy to install. It is another object of the present invention to provide a bus connector which has means to seal off dust from the bus main track to which it is connected. It is still another object of the present invention to provide a bus connector in which the terminals are made in the same shape.

DETAILED DESCRIPTION OF THE PREFERRED EMBODIMENT

Figure 1:
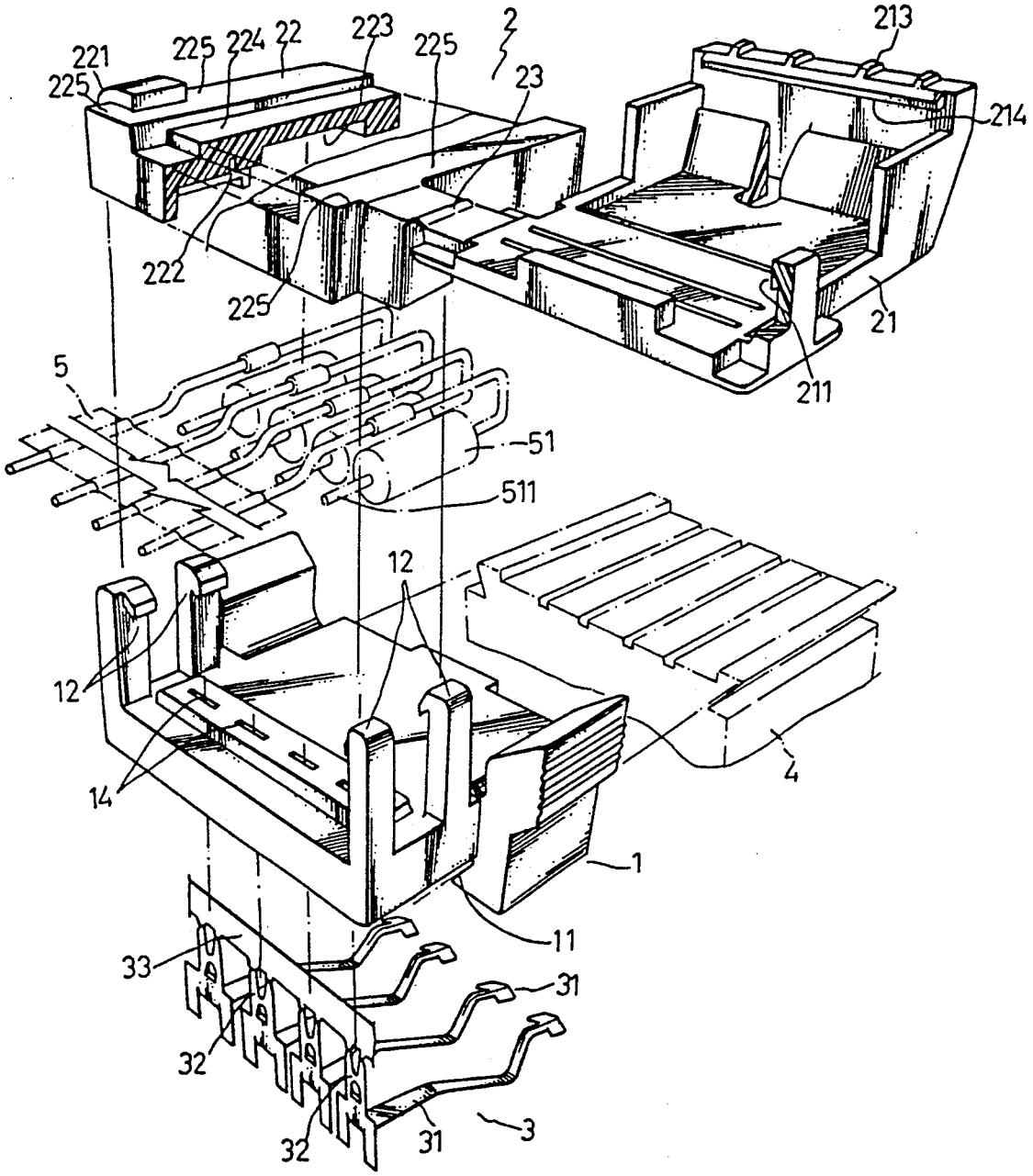
FIG. 1 is an exploded perspective view of the preferred embodiment of the bus connector of the present invention.
Figure 2:
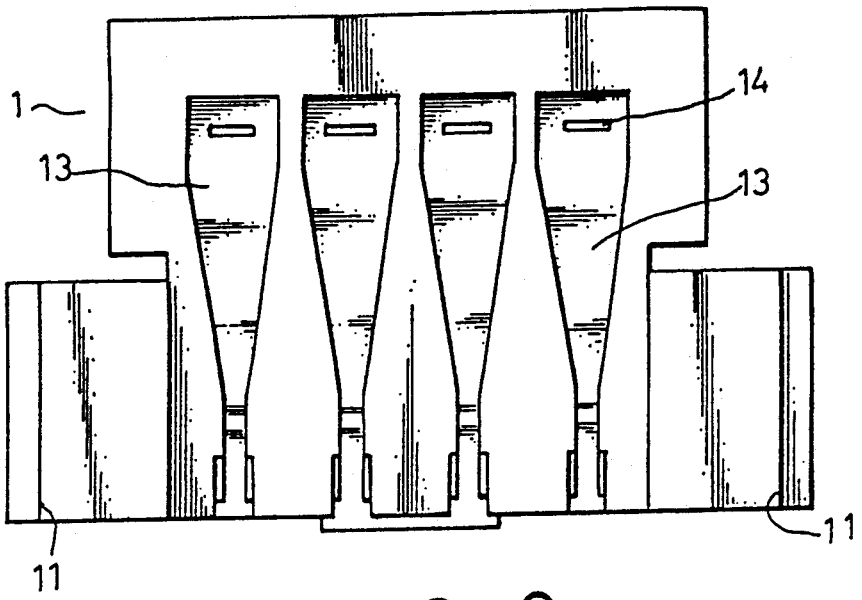
FIG. 2 is a bottom view of the base thereof.

Referring to FIG. 1, a bus connector in accordance with the present invention is generally comprised of a base 1, an upper shell 2 and a terminal unit 3. The base 1 has a dovetail groove 11 on the bottom edge thereof for mounting on a bus main track 4 through dovetail joint, two pairs of hooks 12 vertically raising from the top edge thereof at two opposite sides for holding the upper shell 2 in position, four parallel grooves 13 on the bottom edge thereof (see FIG. 2) for fastening the terminals 31 of the terminal unit 3, and four slots 14 on top edge thereof respectively connected to said parallel grooves 13.

The terminal unit 3 comprises an elongated strip 33, four unitary forks 32 extending from said elongated strip 33 at the same side and respectively disposed in parallel with one another, and four unitary terminals 31 respectively extending from said forks 32 at right angles. The terminals 31 are respectively set in the parallel grooves 13 on the bottom edge of the base 1 permitting the fork 32 to be inserted through the slots 14 for connecting to a bus 5. Because the grooves 13 on the bottom edge of the base 1 are disposed in parallel with one another, the terminals 31 are made in the same shape for convenient installation. The upper shell 2 is comprised of a top cover 21 and a lining block 22. The lining block 22 has a connecting portion 23 made from flexible material and integrally connected to the top cover 21 at one end through which it can be turned inwards and then inserted inside said top cover 21 or turned outwards from said top cover 21, a side flange 221 on the side edge 225 opposite to the side edge 225 connected with the connecting portion 23 thereof releasably retained by a hook 211 on the top cover 21. By hooking the hook 211 of the top cover 21 in the side flange 221 of the lining block 22 and by hooking the two pairs of hooks 12 of the base 1 in the two opposite side edges 225 of the lining block 22, the base 1, the lining block 22 and top cover 21 are firmly retained into shape.

Figure 3:
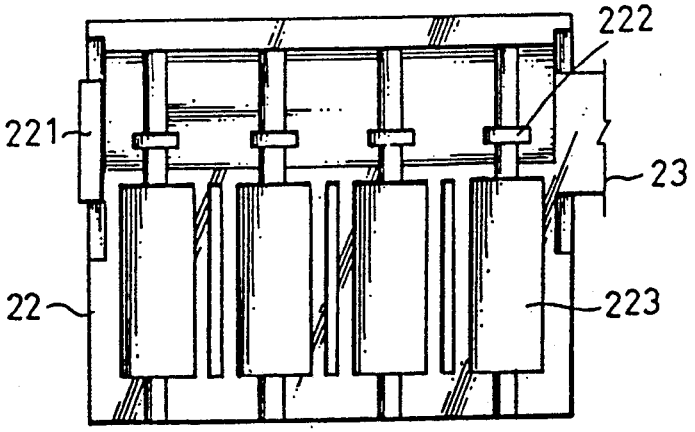
FIG. 3 is a bottom view of the lining for the upper shell thereof.

Referring to FIG. 3 and seeing FIG. 1 again, the top cover 21 has an elongated board 213 on the front end edge thereof for removing dust out of the bus main track 4, and a hooked flange 214 on said elongated board 213 at an inner side; the lining block 22 has four locating grooves 222 on the bottom edge thereof at locations corresponding to the four slots 14 on the base 1, four resistor chambers 223 on the bottom edge thereof at right angles to said locating grooves 222, and a recess 224 on the top edge thereof for inserting the bus 5.

Figure 4:
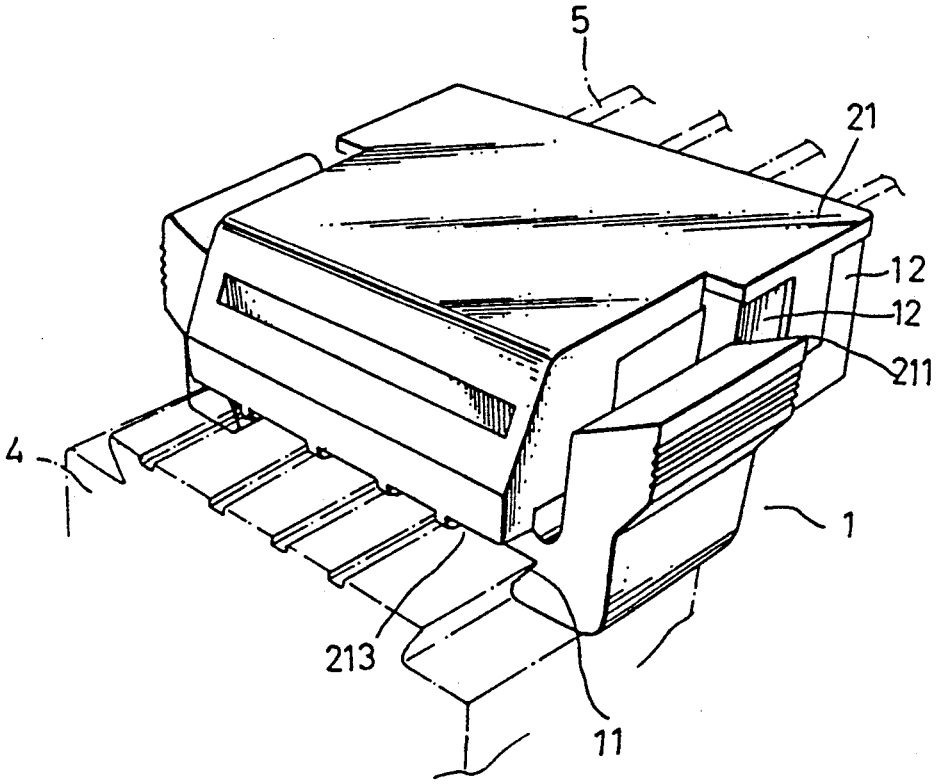
FIG. 4 is a schematic assembly view thereof.

Referring to FIG. 4 and seeing FIG. 1 again, after removal of elongated strip 33, the terminals 31 are inserted in the parallel grooves 13 from the bottom permitting the forks 32 to protrude through the slots 14, the four resistors 51 which are attached to the bus 5 are then inserted in the resistor chambers 223 of the lining block 22 permitting the bus 5 to pass through the recess 224 of the lining block 22, and then, the hook 211 of the top cover 21 is hooked in the side flange 221 of the lining block 22 to firmly retain bus 6 to the upper shell 2. At final, the upper shell 2 is attached to the base 1 permitting the forks 32 to respectively retain the conductors 511 of the resistors 51 in the locating grooves 222 of the lining block 22. At the same time, the base 1 and the upper shell 2 are squeezed together permitting the two pairs of hooks 12 of the base 1 to respectively hook in the two opposite side edges 225 of the lining block 22 and simultaneously causing the front edge of the base 1 to be retained in the hooked flange 214 of the top cover. After assembly, the connector is attached to the bus main track 4 with the elongated board 213 firmly pressed on the top edge of the bus main track, as shown in FIG. 4, and therefore, the bus 5 is electrically connected to the bus main track 4.

What is claimed is:

1. A bus connector, comprising:

a base having a dovetail groove on the bottom edge thereof for mounting on a bus main track by means of dovetail joint, two pairs of hooks vertically rising from the top edge thereof at two opposite sides, four parallel grooves on the bottom edge thereof, and four slots on the top edge thereof respectively connected to said parallel grooves;

an upper shell comprised of a top cover and a lining block, said lining block being connected to said top covering by a unitary, flexible connecting portion through which said lining block can be turned inwards and then inserted inside said top covering, a side flange on a second side edge opposite to a first side edge connected with said connecting portion thereof releasably retained by a hook on said top cover, said side edges being releasably retained by said two pairs of hooks of said base, said top cover having an elongated board on the front end edge thereof for removing dust out of said bus main track and a hooked flange on said elongated board at an inner side thereof to retain said base on said top cover, said lining block having: four locating grooves on the bottom edge thereof at locations corresponding to said four slots on said base, four resistor chambers on the bottom edge thereof at right angles relative to said locating grooves for holding four resistors on a bus and a recess on the top edge thereof for inserting said bus;

a terminal unit comprising, four unitary forks in parallel with one another, and four terminals respectively extending from said forks at right angles, said four terminals being made in the same shape and respectively inserted in said parallel grooves, said forks being inserted through said slots to retain conductors from said resistors in said locating grooves inside said lining block; and wherein said base is attached to said bus main track with said elongated board firmly pressed on said bus main track at the top permitting said bus to be electrically connected to said bus main track.

* * * * *